United States Patent [19]

Evans

[11] 4,214,744

[45] Jul. 29, 1980

[54] SNUBBING APPARATUS

[75] Inventor: Donald J. Evans, Cherry Hill, N.J.

[73] Assignee: Molins Machine Company, Inc., Cherry Hill, N.J.

[21] Appl. No.: 913,616

[22] Filed: Jun. 8, 1978

[51] Int. Cl.[2] ..... B65H 29/66

[52] U.S. Cl. ..... 271/202; 198/836; 271/216; 271/273

[58] Field of Search ..... 271/184, 202, 203, 198, 271/216, 274, 273, 272; 198/836, 423; 271/80, 69, 199, 200, 201, 182, 229, 230; 83/88

[56] References Cited

U.S. PATENT DOCUMENTS

| | | | |
|---|---|---|---|
| 3,254,886 | 6/1966 | Miller | 271/202 X |
| 3,481,598 | 12/1969 | Lopez | 271/184 |
| 3,507,489 | 4/1970 | Wilshin et al. | 271/202 X |
| 3,880,420 | 4/1975 | Martin | 271/184 |
| 3,881,721 | 5/1975 | Hitch | 271/184 |
| 3,997,155 | 12/1976 | Martin | 271/184 X |
| 4,099,712 | 7/1978 | Martin | 271/184 |

*Primary Examiner*—Bruce H. Stoner, Jr.

*Attorney, Agent, or Firm*—Seidel, Gonda, Goldhammer & Panitch

[57] ABSTRACT

A plurality of sets of aligned rollers are guided for movement along a shingling conveyor. While one set of such rollers is in an operative position snubbing sheets as they are delivered to the shingling conveyor, another set of such rollers is inoperative and can be moved to a ready position for the next production order. The rollers are movable downwardly to a snubbing position and upwardly to an inoperative position.

11 Claims, 4 Drawing Figures

FIG. 3
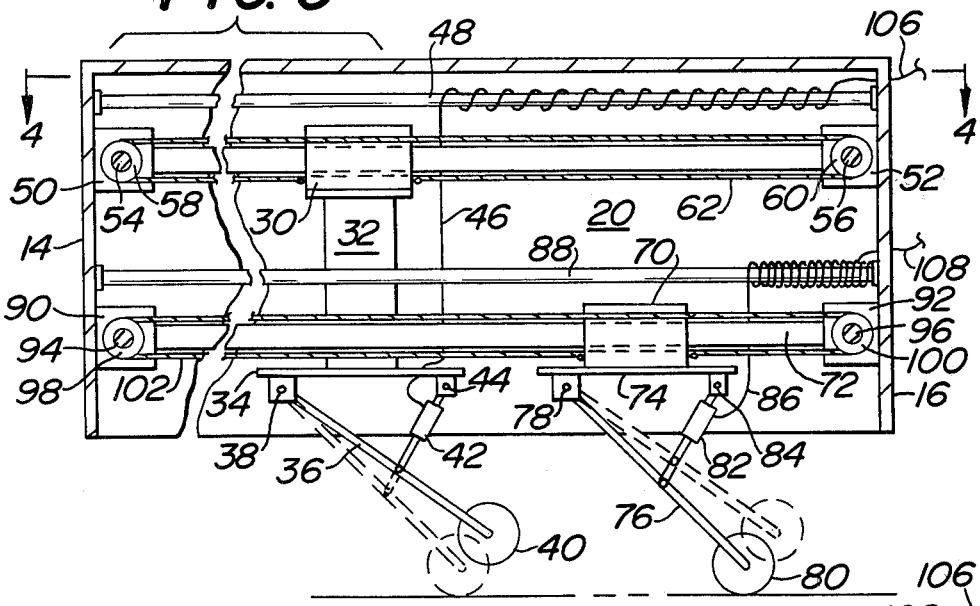
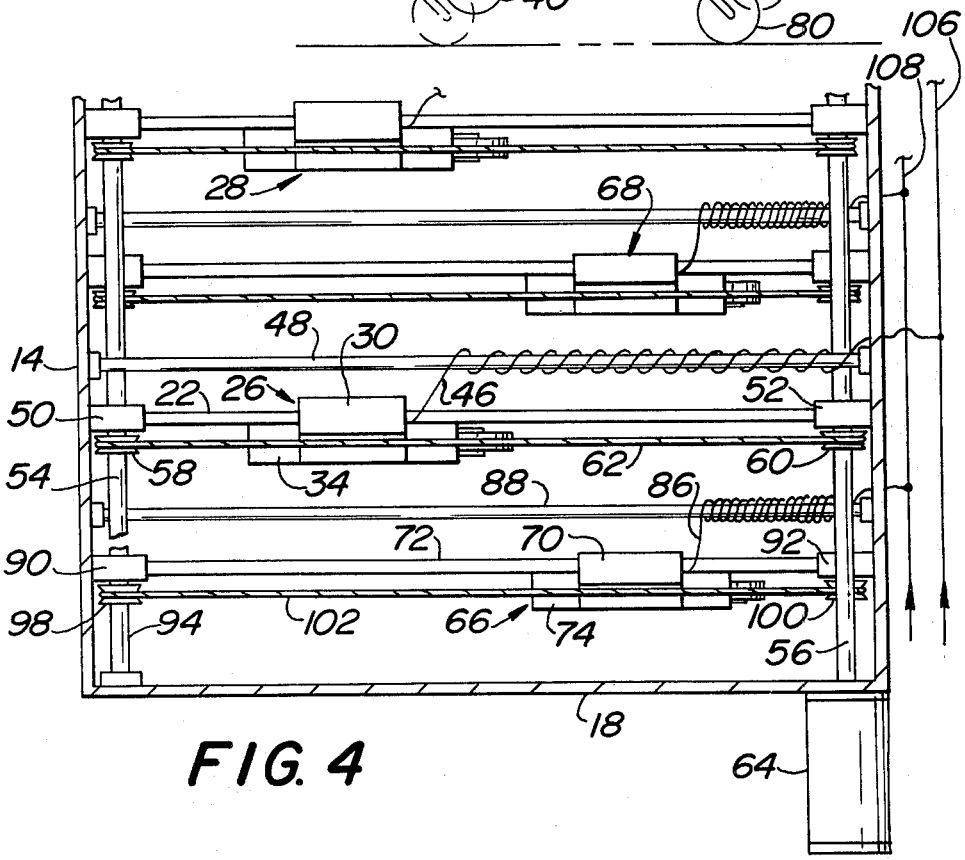
FIG. 4

SNUBBING APPARATUS

RELATED CASE

This application is related to copending application Ser. No. 903,350 entitled "Continuous Running Corrugator" filed on May 5, 1978.

BACKGROUND

It is old in the art to have a shingling conveyor at the discharge end of a corrugator. When sheets are discharged at high speeds onto the shingling conveyor, they tend to become disorganized and must be snubbed downwardly onto the conveyor. As a corrugator is changed from one production order to another, the change quite commonly involves a change in the length of the sheets. As the length of the sheets is changed, the position of the snubbing roller must be changed. For high speed operation in an efficient manner, it is necessary to change the position of the snubbing roller very quickly. The present invention is directed to a solution to the problem of being able to quickly change the position of a snubbing roller supported above the shingling conveyor.

SUMMARY OF THE INVENTION

The present invention is directed to snubbing apparatus for snubbing sheets on a shingling conveyor. The apparatus includes a support having guide means. A plurality of aligned rollers are guided for movement by the guide means so that the rollers can be positioned at different locations for snubbing different length sheets. A motor means is connected to said rollers for moving said rollers along said guide means. A power means is connected to each roller for selectively moving each roller downwardly to a snubbing position and upwardly to an inoperative position.

The preferred embodiment of the present invention includes two sets of snubbing rollers which are independently operable so that a first set of snubbing rollers may be prepositioned to a ready position while the second set of snubbing rollers is operating on a production order. When the production order is completed, the first set of snubbing rollers need only be moved downwardly from their inoperative position to their operative position for snubbing the new sheet length of the new production order.

It is an object of the present invention to provide novel snubbing apparatus for use with a shingling conveyor.

It is another object of the present invention to provide snubbing apparatus which facilitates a rapid change of snubbing action in connection with a production change order in a manner which is simple, reliable, and efficient.

Other objects will appear hereinafter.

For the purpose of illustrating the invention, there is shown in the drawings a form which is presently preferred; it being understood, however, that this invention is not limited to the precise arrangements and instrumentalities shown.

FIG. 3 is a sectional view taken along the line 3—3 in FIG. 2.

FIG. 4 is a sectional view taken along the line 4—4 in FIG. 3.

Figure 1:
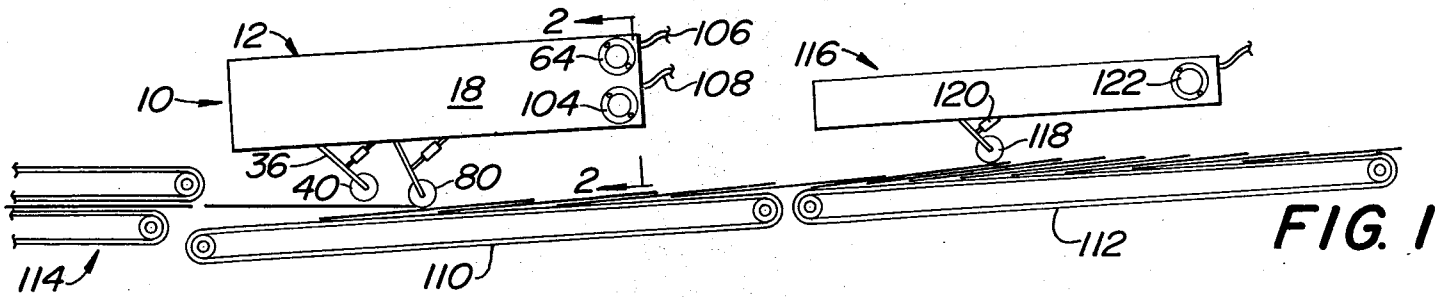
FIG. 1 is a side elevation view of shingling conveyors incorporating the snubbing apparatus of the present invention.

Referring to the drawings in detail, wherein like numerals indicate like elements, there is shown snubbing apparatus designated generally as 10. The snubbing apparatus 10 includes a support such as housing 12. The housing 12 is suspended from above by brackets not shown.

The housing 12 includes end walls 14 and 16 and side walls 18 and 20. The housing 12 is elongated in the direction of the side walls 18 and 20. Generally, the length of the housing 12 exceeds the width of the housing 12 but special sheet sizes may require the width to exceed the length. Housing 12 is provided with an open bottom. As shown, housing 12 has a top wall but this is optional. If the housing 12 is provided with a bottom wall, such bottom wall must be provided with longitudinal slots for accommodating roller support assemblies to be described hereinafter.

Figure 2:
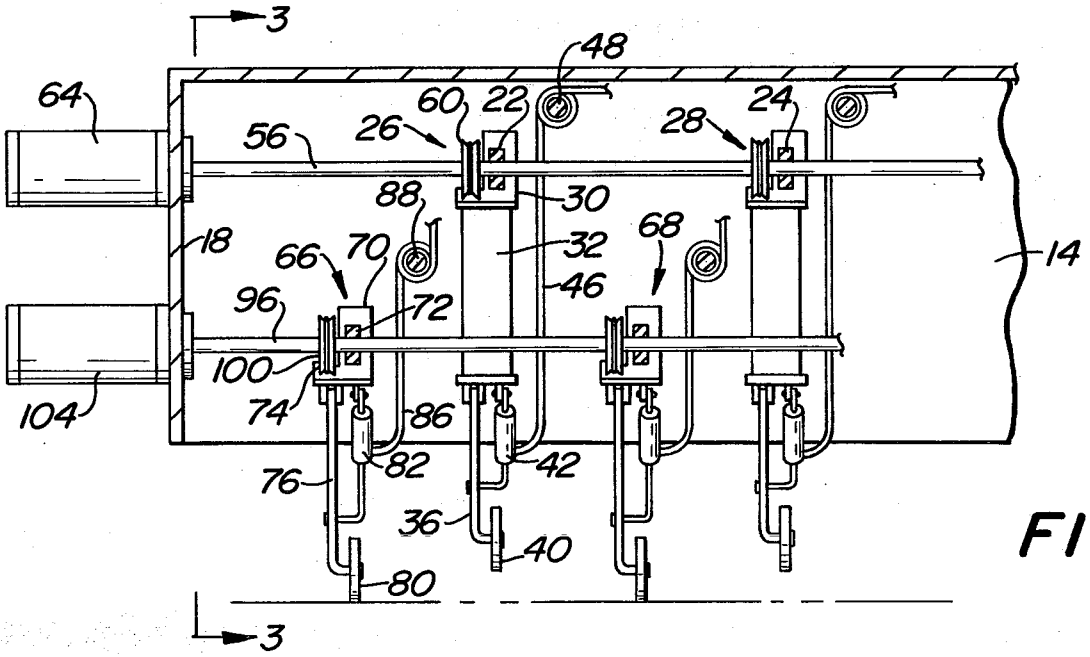
FIG. 2 is a sectional view taken along the line 2—2 in FIG. 1.

The housing 12 supports first and second sets of roller support assemblies. The first set includes a plurality of such assemblies disposed side-by-side and movable in unison longitudinally of the housing 12. The first set includes roller support assemblies 26 and 28. See FIG. 2. Assembly 26 is guided for movement along the length of guide track 22 while assembly 28 is guided for movement along the guide track 24. Since the assemblies 26 and 28 are identical, only assembly 26 will be described in detail.

The roller support assembly 26 includes a header 30 which is guided by the track 22. Header 30 has a depending extension 32. Extension 32 is connected at its lower end to a base plate 34. An arm 36 is connected at its upper end to a pivot pin 38 on the base plate 34. The lower end of arm 36 rotatably supports a roller 40. Roller 40 is shown in its inoperative position. A power means is provided for selectively moving the roller 40 downwardly to a snubbing position and upwardly to its inoperative position.

The power means associated with roller 40 preferably includes a pneumatic cylinder 42 having a piston therein connected to a piston rod which is biased downwardly by a spring in cylinder 42 and not shown. One end of the cylinder is connected to the arm 36. The exposed end of the piston rod is pivotably connected to the base plate 24 by pivot pin 44. See FIG. 3.

Motive fluid to bias the piston in cylinder 42 upwardly against the spring bias is supplied to the cylinder 42 by way of a flexible conduit 46. The conduit 46 extends upwardly to a supply portion of the conduit coiled around rod 48. Rod 48 extends between and is supported by the end walls 14, 16. The coiled supply portion of conduit 46 disposed around rod 48 is of sufficient length so as to enable the conduit 46 to remain coupled to the cylinder 42 at all positions of the assembly 26 along the length of the track 22. The cylinder 42 raises and lowers the roll 40 between the solid line and phantom positions shown in FIG. 3. It is within the skill of the art to substitute other types of power means, such as a solenoid, for the cylinder 42.

A bracket 50 is secured to the end wall 14. A mating bracket 52 is secured to the end wall 16. Bracket 50 rotatably supports a shaft 54 extending transversely across the housing 12 between the side walls 18 and 20. A shaft 56 is similarly supported by the bracket 52. The shafts 54, 56 are at the same elevation and are parallel to one another. A pulley 58 is secured to shaft 54. A pulley 60 is secured to shaft 56. A cable 62 extends around the pulleys 58, 60 and has its free ends attached to the header 30. See FIG. 3.

A motor means is coupled to one of the shafts 54, 56. In the illustrated embodiment, an A.C. positioning motor 64 is connected of the shaft 56. The usual components, not shown, are provided with the A.C. positioning motor 64 so that it may accurately position header 30 along the length of track 22 by rotating shaft 56 through a predetermined number of revolutions. Assembly 28 and all other assemblies of the first set likewise move simultaneously with assembly 26.

The second set of roller support assemblies is independently operable from the first set of assemblies. The second set of assemblies includes roller support assemblies 66 and 68. See FIG. 2 wherein assemblies 66, 68 are at a different elevation from the elevation of assemblies 26, 28 and are staggered with respect to the same. Thus, the assemblies 66, 68 may be moved in unison regardless of the position of the assemblies 26, 28.

The assemblies 66, 68 are identical. Hence, only assembly 66 will be described in detail. Assembly 66 includes a header 70 guided for movement along the length of guide track 72. Guide track 72 is parallel to guide track 22 but is at a lower elevation as will be apparent from FIGS. 2 and 3. A base plate 74 is connected to the lower end of header 70. Due to the lower elevation of assembly 66, the assembly 66 does not require a component comparable to extension 32.

An arm 76 is pivotably connected at its upper end to the base plate 74 by pivot pin 78. A roller 80 is rotatably supported by the lower end of arm 76. As illustrated, the roller 80 is in an operative position. Roller 80 may be moved to an inoperative position shown in phantom in FIG. 3 by means of cylinder 82. Cylinder 82 is identical to cylinder 42 and has a piston rod connected at its free end to the base plate 74 by pivot pin 84. One end of a flexible supply conduit 86 is connected to the cylinder 82 and extends upwardly to the rod 88 around which the remainder of the conduit 86 is coiled. Rod 88 extends between the walls 14 and 16.

A bracket 90 is secured to the wall 14 and a bracket 92 is secured to the wall 16. A shaft 94 is rotatably supported by the bracket 90. A shaft 96 is rotatably supported by the bracket 92. As shown in FIG. 3, shaft 94 is directly below shaft 54 and shaft 96 is directly below shaft 56. As shown in FIG. 4, a portion of shaft 54 has been broken away at the bottom end of the figure so as to expose a portion of shaft 94.

A pulley 98 is secured to shaft 94. A pulley 100 is secured to shaft 96. A cable 102 extends around the pulleys 98 and 100. The free ends of the cable 102 are connected to the header 70. See FIG. 3.

The manifold conduit 106 is provided for supplying motive fluid to the assemblies 26 and 28. A manifold conduit 108 is provided for supplying motive fluid to the assemblies 66, 68. See FIGS. 1 and 4. The supply and exhaust valves for the manifold conduits 106, 108 are not shown.

The housing 12 is supported by brackets not shown so as to be exposed above a first shingling conveyor 110 which in turn is aligned with a second shingling conveyor 112. The input end of conveyor 110 is adjacent to the discharge end of sandwich conveyor 114.

Snubbing apparatus 116 is disposed above the shingling conveyor 112. Apparatus 116 is the same as apparatus 10 except as will be made clear hereinafter. Since the sheets are already shingled when received on the conveyor 112, only a single bank of snubbing rollers 118 is necessary. Roller 118 is provided with a power means 120 and is otherwise identical to any of the previously described assemblies 26, 28, 66 or 68. Movement of the roller 118 along the guide track associated therewith is attained by way of a positioning motor 122. Conveyor 112 discharges the shingled sheets to a stacker.

The apparatus of the present invention is utilized as follows. Let it be assumed that the assemblies 66 and 68 have their rollers in an operative lowermost position as illustrated. The rollers 80 are positioned across the width of the conveyor 110 so as to snub the leading edge of the sheets as they are discharged from conveyor 114 onto the shingling conveyor 110. The speed of conveyor 110 is substantially slower than the speed of conveyor 114 so as to cause the sheets to form a shingle on conveyor 110.

Let it be assumed that the sheets for the next production order will be shorter than the sheets being processed as illustrated in FIG. 1. Positioning motor 64 is activated to cause the support assemblies 26, 28, etc. of the first set to move longitudinally along their respective guide tracks to the position shown in FIGS. 1 and 3 and with the rollers thereof being retained in their inoperative uppermost position. Thus, the rollers 40 will be prepositioned so as to be at the proper location to snub the leading end of the sheets for the next production order.

As described in greater detail in the above-mentioned copending application Ser. No. 903,350, during any production changeover, it is considered desirable to maintain uniform the speed of the double factor machine producing the web from which the sheets are cut. Upon completion of one production order, the web is severed transversely and the speed of one web section is changed relative to the other so as to create a gap. The speed of shingling conveyor 110 is accelerated at or prior to the severing of the web. It is desired to maintain at least a portion of the gap on the shingling conveyor 110 between the last sheet of one production order and the first sheet of a new production order. While the gap is present on the conveyor 110, the power means associated with the assemblies 26, 28, etc. will be activated in any convenient manner to cause the rollers 40 to descend to an operative position while the power means associated with the assemblies 68, 70, etc. causes the rollers 80 to ascend to their inoperative position.

As soon as the first sheet of the next production order is deposited on the conveyor 110, the rollers 40 will now be in a position to snub the leading edge of the first and subsequent sheets of the next production order. As described in the above-mentioned copending application, as soon as the first sheet of a new production order is deposited on the conveyor 110, the speed of the shingling conveyor 110 will be decreased so as to provide for a shingling ratio of less than 2:1.

While rollers 40 snub the leading edge of the sheets of the new production order, motor 104 can be activated to move the assemblies 66, 68 either forwardly or rearwardly with respect to the assemblies 26, 28 so as to locate the rollers 80 at the required position for a subsequent production order whereby the rollers 80 will be in position to snub the leading edge of the sheets for the subsequent production order. Due to the fact that the roller assemblies of the first set are staggered with respect to the roller assemblies of the second set, such movement of one set of roller assemblies to a ready position does not in any way interfere with snubbing of the then existing production order by the rollers of the other set.

As described above, the use of two sets of roller assemblies enables one set to be operative while the other set is inoperative and readily adjustable to any predetermined position for the next production order. During change-over, the rollers of the inoperative set are moved downwardly to an operative position and vice versa. Since the roller assemblies do not have to be moved to the new snubbing position during a production order change-over, adjustment of the snubbing rollers is extremely fast whereby such adjustment may occur while the gap in the web is present on the conveyor 110. Due to the high speeds involved, there is insufficient time to move a snubbing roller assembly from one operative position to a second operative position during a production order change so that the snubbing roller will be in the proper position to snub the leading edge of the first sheet of the subsequent production order. As will be apparent from the drawings and the above description, the apparatus of the present invention is simple, inexpensive and reliable for snubbing sheets of a shingling conveyor such as conveyor 110. Since the sheets are already shingled when deposited on conveyor 112, a single bank of snubbing rollers 118 may be utilized and need only be moved to the most efficient position for holding down the shingled sheets and such movement may occur at any time during a production order. That is, roller 118 need not be adjusted while the gap exists on conveyor 112.

The present invention may be embodied in other specific forms without departing from the spirit or essential attributes thereof and, accordingly, reference should be made to the appended claims, rather than to the foregoing specification as indicating the scope of the invention.

I claim:

1. A snubbing apparatus for snubbing sheets on a shingling conveyor comprising a support having guide means, a plurality of sets of aligned rollers guided for movement by said guide means so as to enable each set of rollers to be positionable at different locations for snubbing different length sheets, motor means for moving each set of rollers along their respective guide means, power means connected to each roller for selectively moving the same downwardly to a snubbing position and upwardly to an inoperative position, each roller being supported by an arm, each arm being pivotably connected at its upper end to a base plate, each base plate being connected to a discrete header guided for parallel movement along said guide means, said guide means including a track for each header, and said tracks being parallel to one another.

2. Apparatus in accordance with claim 1 including means supporting said sets in a staggered manner so that the rollers of the first set may be in an inoperative position and can be moved past the location of the rollers of the second set while the rollers of the second set are in an operative position.

3. Apparatus in accordance with claim 2 wherein the rollers of the first set are supported from above at a common elevation and the rollers of the second set are supported from above at a different elevation.

4. Apparatus in accordance with claim 1 wherein each roller is supported by a discrete arm, said power means connected to each roller including a discrete actuator connected to each arm and movable along the guide means with its associated arm, said power means including means connected to each actuator for activating the same at any position along the length of the associated guide means.

5. Apparatus in accordance with claim 4 wherein each actuator is a power cylinder and the last-mentioned means includes a flexible conduit connected to each cylinder.

6. Apparatus in accordance with claim 1 wherein each roller is supported from above by an arm connected to a base plate, each base plate being connected to a header guided by a discrete track constituting part of said guide means, a discrete cable means connected to each header, a pair of parallel shafts having sets of pulleys thereon, each cable means beng trained around a set of said pulleys, and motor means connected to said shaft for causing said movement of said rollers along their respective track means to such locations.

7. A snubbing apparatus for snubbing sheets comprising a support, said support having a plurality of parallel guide tracks mounted thereon, first and second sets of aligned rollers, the rollers of each set being staggered with respect to the rollers of the other set, each of the rollers being at substantially the same elevation and being movable downwardly to a snubbing position and upwardly to an inoperative position, each roller being supported by one of said guide tracks for movement along the length of its associated guide track so as to be positionable at different locations for snubbing different length sheets, and means for moving all of the rollers of one set while the rollers are in their inoperative position along the length of their respective guide tracks while all of the rollers of the second set are in their operative sheet snubbing position, and power means associated with each roller for selectively moving said rollers between operative and inoperative positions at all locations along the length of said guide tracks.

8. Apparatus in accordance with claim 7 wherein the guide tracks associated with the first set are at a different elevation from the guide tracks associated with the second set.

9. Apparatus in accordance with claim 7 including a shingling conveyor disposed below said support for moving shingled sheets in a direction parallel to said guide tracks, said rollers being juxtaposed to said conveyor in their operative position for contact with sheets on said conveyor.

10. Apparatus in accordance with claim 7 including a separate motor means for moving the rollers of each set along the length of their guide tracks.

11. Snubbing apparatus for snubbing sheets on a shingling conveyor comprising first and second set of rollers, guide means at a first elevation for guiding the rollers of the first set for movement in a first direction perpendicular to the axes of rotation of the rollers, guide means at a second elevation for guiding the rollers of the second set for movement in a direction parallel to said first direction, a discrete motor means for independently moving each set of rollers along its respective guide means, and power means for selectively moving the rollers of each set in unison downwardly to a snubbing position and upwardly to an inoperative position, the rollers of each set being at substantially the same elevation when at their operative position.

* * * * *